US005082156A

United States Patent [19]

Braun

[11] Patent Number: 5,082,156

[45] Date of Patent: Jan. 21, 1992

[54] TOOL WRIST STRAP

[76] Inventor: Thomas D. Braun, 6822 Lakecrest Ct., Fort Wayne, Ind. 46815

[21] Appl. No.: 83,580

[22] Filed: Aug. 7, 1987

[51] Int. Cl.[5] ..... A45F 3/14

[52] U.S. Cl. ..... 224/220; 224/221; 224/254; 224/901

[58] Field of Search ..... 224/901, 219, 220, 217, 224/218, 221, 101, 150, 214, 254, 917; 2/275, 338; 280/822

[56] References Cited

U.S. PATENT DOCUMENTS

| | | | |
|---|---|---|---|
| 534,946 | 2/1895 | Bates | 224/220 |
| 625,469 | 5/1899 | Schepers . | |
| 774,143 | 11/1904 | Adams . | |
| 1,325,717 | 12/1919 | Gorton | 2/338 |
| 1,364,666 | 1/1921 | Wilder | 2/338 X |
| 1,572,289 | 2/1926 | Hogan | 224/220 |
| 2,151,389 | 3/1939 | Morgan | 2/338 X |
| 2,224,036 | 12/1940 | van Voorhis | 2/338 X |
| 2,522,719 | 9/1950 | Johnson . | |
| 2,812,123 | 11/1957 | Girton | 224/151 X |
| 3,163,436 | 12/1964 | Shride et al. | 280/822 |
| 3,294,299 | 12/1966 | Brennan . | |
| 3,854,640 | 12/1974 | Willmarth | 224/220 |
| 4,047,651 | 9/1977 | McMullen | 2/338 X |
| 4,252,344 | 2/1981 | Larsen | 280/822 |
| 4,273,275 | 6/1981 | Vadnais | 224/101 |
| 4,315,641 | 2/1982 | Larsen . | |
| 4,322,077 | 3/1982 | Van't Hof . | |
| 4,489,867 | 12/1984 | Schwemberger . | |
| 4,528,700 | 7/1985 | Johnston | 2/338 |
| 4,561,128 | 12/1985 | Zimmerman | 2/275 |
| 4,728,123 | 3/1988 | Kassal et al. | 280/822 |

FOREIGN PATENT DOCUMENTS

| | | | |
|---|---|---|---|
| 3023668 | 1/1982 | Fed. Rep. of Germany | 224/219 |
| 5174 | of 1908 | United Kingdom | 224/220 |
| 24107 | of 1909 | United Kingdom | 224/220 |
| 160400 | 3/1921 | United Kingdom | 224/220 |

*Primary Examiner*—Linda J. Sholl
*Attorney, Agent, or Firm*—George Pappas

[57] ABSTRACT

A tool wrist strap having a band, a looped cord and a clench bead on the cord. The band is made of a flexible elastic fabric material and formed by an elongated strip having opposite ends attached together. The band is preferably adapted to fit loosely about a person's wrist. The looped cord is composed of flexible inelastic material and has a looped end portion and a pair of opposite ends attached to the band adjacent to one another. The clench bead is slidable on the looped cord and produces sufficient friction therewith to hold the bead in any given position along the cord. The bead can be slidably moved by a person's hand in opposing directions away from and toward the looped end portion of the cord for respectively untightening and tightening the looped end portion in a noose-like configuration about a portion of a tool.

8 Claims, 2 Drawing Sheets

TOOL WRIST STRAP

BACKGROUND OF THE INVENTION

1. Field of the Invention

The present invention generally relates to accessories for aiding persons in the use of hand tools and, more particularly, is concerned with a tool wrist strap for catching a dropped tool and holding it in proximity to the person's hand.

2. Description of the Prior Art

Persons engaged in repair and construction type work ordinarily have to use a variety of hand-tools to perform their tasks. Their work commonly takes place over machinery and/or on platforms at various heights above the ground.

Obviously, for many reasons, such persons seek to avoid dropping their tools. One reason is simply that the dropped tool must be picked up before the person can continue using it to complete the particular task. This can entail wasted time and energy in climbing down from a considerable height just to pick up the tool. Frequently, the tool will land at a place out of the user's sight and so a search may have to be undertaken to locate the tool. This circumstance increases the amount of time wasted in retrieving the dropped tool. Another, more serious reason is that the dropped tool exposes persons located below to potential injury or even death if they are struck by the falling tool. Still another reason is that the dropped tool has the potential to cause damage to machinery located below. The damage can result in many ways. For instance, the damage can be due to the impact of the falling tool on the machinery or parts. Where the machinery is operating at the time, the falling tool may come to rest in the path of moving components causing damage thereto and/or necessitate shutting down the machinery.

While without doubt, persons using hand tools try to maintain sufficient grip on them, conditions are practically certain to arise in which tools will be dropped. For instance, moisture from sweating frequently makes it difficult to maintain the necessary grip on the tool handle. Muscular fatigue can cause the person to loosen his or her grip without consciously realizing it. In reaction to an unexpected slip, the person may unconsciously drop the tool in grabbing for some support structure to prevent or cushion the fall.

The problem of inadvertent release or dropping of hand tools has been recognized for many years as evidenced by U.S. Pat. No. 774,143 to Adams in 1904. Devices for attaching articles, such as a key, tennis racket, handbag and ski pole, to a person's wrist have also been proposed in the prior patent art. See U.S. Pat. Nos. to Johnson (2,522,719), Brennan (3,294,299), Larsen (4,315,641), Van't Hof (4,322,077) and Schwemberger (4,489,867). However, none of these devices appear to embody a construction that is suited to provide an optimum solution to the above-described problem.

Consequently, a need still exists for a device or accessory which will be found by users to be economical, convenient, and safe to use and effective in preventing inadvertent dropping of a tool.

SUMMARY OF THE INVENTION

The present invention provides a tool wrist strap designed to satisfy the aforementioned needs. To provide the tool wrist strap of the present invention, a strip of flexible elastic fabric or cloth material is formed into a band adapted to fit loosely about a person's wrist, and the band is united with a loop of flexible inelastic cord having a friction-producing clench bead slidable thereon for tightening an end portion thereof in a noose-like configuration about a portion of a tool. In different embodiments of the strap of the present invention, different attachment arrangements are employed for connecting the ends of the strip together to form the band and for anchoring the adjacent ends of the looped cord to the band. Depending upon which of the attachment arrangements is used, the ends of the band will disconnect or breakaway from one another, the cord loop will detach from the band, or the loosely-fitted band will slip off the wrist, each in response to imposition of a pulling force on the cord loop which exceeds that caused by mere dropping of a tool but which would be experienced if the cord loop became entangled in moving components of machinery.

Accordingly, the present invention is directed to a tool wrist strap which includes a band of flexible substantially elastic fabric material formed by an elongated strip thereof having opposite ends attached together, the band being adapted to fit loosely about a person's wrist. A looped cord of flexible substantially inelastic material having a looped end portion and a pair of opposite ends is attached to the band adjacent to one another and, a friction-producing clench member is slidably received on the looped cord and is slidable in opposing directions away from and toward the looped end portion for respectively untightening and tightening the end portion in a noose-like configuration about a portion of a tool.

More particularly, in one form, the clench member has an outer plastic casing with a bore defined therethrough to receive the looped cord and an internal annular recess in the bore. A rubber O-ring is disposed in the recess. The O-ring is of such inside diametric size smaller than the cross-sectional size of the looped cord that it frictionally crimps or squeezes the cord as it passes therethrough. In another form, the clench member is composed or made of a round body of rubber material or a plastic material and having a bore defined therethrough and being sized to receive and frictionally squeeze the looped cord.

Further, several different attachment arrangements are employed in the strap between the opposite ends of the strip to form the strap band and attach adjacent ends of the looped cord and the band. In one attachment, one of the ends of the strip is doubled back on itself to form a pocket to receive the adjacent opposite ends of the looped cord. The doubled back strip end is then overlapped with the other strip end and the strip ends and looped cord ends are all secured together, such as by being stitched to one another.

In another attachment arrangement, one of the ends of the strip is again doubled back on itself to form the pocket for the adjacent opposite ends of the looped cord. The doubled back strip end and the looped cord ends are secured, such as by stitching, together. Patches of complementary fastening materials, such as pile material and hook material sold under the trademark VELCRO, are attached respectively to facing sides of the doubled back strip end and the opposite strip end. The VELCRO patches on the respective strip ends are pressed together to complete the band. The ends of the strip, and thus of the completed band, are detachable by applying sufficient pulling force to peel the VELCRO patches apart and reattachable by applying sufficient compression force to press them back together.

In still another attachment arrangement, one of the ends of the strip is again doubled back on itself and then overlapped with and stitched to the opposite strip end to complete the band. Either a single snap connector of a pair of snap connectors are attached respectively to the band and the adjacent looped cord ends. Each snap connector is composed of male and female parts. By way of example, the female part of each connector is attached to the adjacent ends of the cord loop and the male part of the connector is attached to the band. The male connector part can be attached at any location on the band, but preferably is located adjacent to the overlap of the strip ends. The looped cord is detachable from the band by applying sufficient pulling force to the cord to unsnap the parts of the snap connector or connectors from one another. Of course, the male and female parts of the connector or connectors can be snapped back together to reattach the looped cord to the band.

In yet another attachment arrangement, one of the ends of the strip is again doubled back on itself and then overlapped with and stitched to the opposite strip end to complete the band. A separate piece of material, being preferably the same as the material of the strap, is folded back on itself to form a pocket which receives the adjacent ends of the looped cord. The folded separate piece of material and the looped cord ends are stitched together. At a separate location on the band and on a face of the separate piece of material are attached respective complementary VELCRO patches. The VELCRO patches are then pressed together to attach the looped cord to the band. Here, also, the looped cord is detachable from and reattachable to the band by applying sufficient respective pulling and compression forces to the VELCRO patches.

In another attachment arrangement, the adjacent strands of the looped cord are heated and melted together at a location spaced a short distance for the adjacent opposite ends thereof. This causes a weakening of the cord at this location. One of the ends of the strip is doubled back on itself to form a pocket to receive the adjacent looped cord ends. The doubled back strip end is overlapped with the other strip end and the strip ends and looped cord ends are all stitched together. Here, the looped cord can be severed from its stitched ends and the band by applying a sufficient pulling force to the cord to break the cord at its weakened location. Once the cord is severed, the strap cannot be reused.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE PREFERRED EMBODIMENTS

Figure 1:
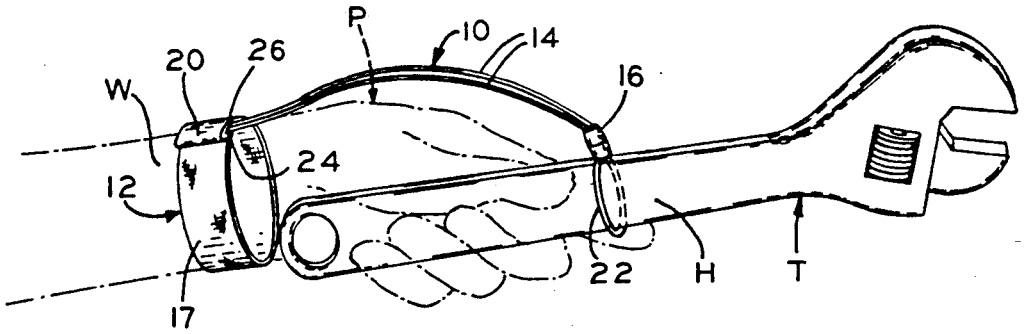
FIG. 1 is a pictorial view of one embodiment of the tool wrist strap of the present invention attached to a person's wrist and a handle of a tool also gripped by the person's hand.

In the following description, like reference characters designate like or corresponding parts throughout the several views of the drawings. Also in the following description, it is to be understood that such terms as "forward", "left", "upwardly" and the like are words of convenience and are not to be construed as limiting terms.

Referring now to the drawings, and particularly to FIG. 1, there is shown a tool wrist strap, generally designated by the numeral 10 and constituting one embodiment of the present invention. The tool wrist strap 10 is shown in FIG. 1 as it would typically be seen during use. As depicted, the strap 10 has a band 12 by which it is attached to a person's wrist W and a looped cord 14 by which it is attached to a handle H of a tool T, such as a so-called monkey wrench. The tool handle H is also gripped by the person's hand P. Due to its selected length of about seven to ten inches, the strap cord 14 under normal conditions will extend closely along the person's hand H where the cord 14 is less likely to inadvertently snag on some nearby structure.

Figure 4:
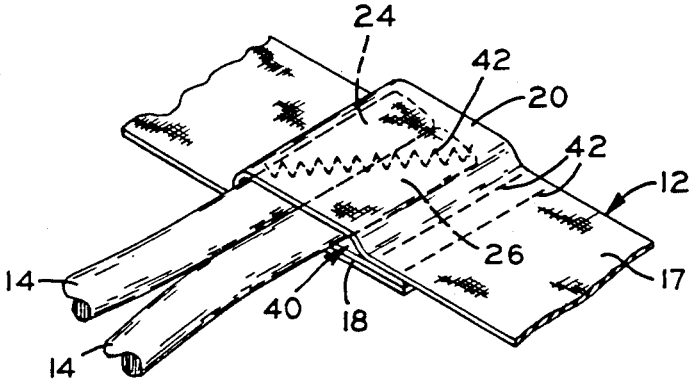

In its basic components, the tool wrist strap 10 includes a clench bead 16 in addition to the band 12 and looped cord 14. The band 12 of the strap 10 is formed by an elongated strip 17 composed of a flexible elastic fabric material and having opposite ends 18 and 20 (see FIG. 4) attached together. The band 12 is preferably adapted to fit loosely about the person's wrist W. One suitable material for the strip 17 and, thus, for the band 12 is preferably an elastic cotton fabric material, although an elastic nylon webbing belt-type material is also acceptable. The width of the strip 17 is preferably from one-half to one inch.

The looped cord 14 of the strap 10 is composed of a braided strand of flexible inelastic material. One suitable material is preferably a hollow grade type polypropylene cord conventionally referred to as parachute cord and is approximately one-eighth inch thick in diameter. The length of the cord 14 is preferably fourteen to twenty inches so that its looped length will be from seven to ten inches. The polypropylene cord has a high tensile strength and is resistant to dirt, grime and moisture. The looped cord 14 has a looped end portion 22 and a pair of opposite ends 24 and 26 (see FIG. 4) attached to the band 12 adjacent to one another.

Figure 2:
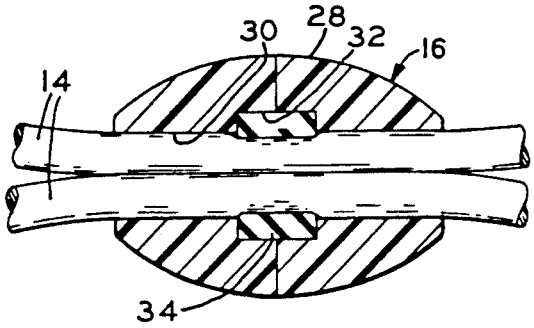
FIG. 2 is an enlarged longitudinal axial sectional view of one form of a friction-producing clench bead slidably mounted on a looped cord of the tool wrist strap of FIG. 1, the looped cord being shown in fragmentary elevational form.
Figure 3:
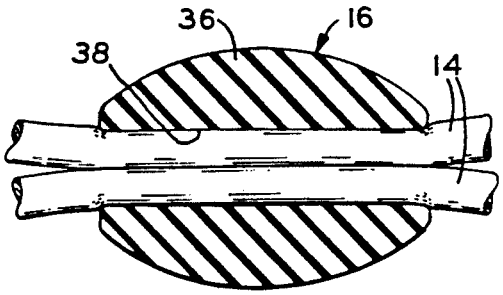
FIG. 3 is an enlarged longitudinal axial sectional view similar to that of FIG. 2, but showing another form of the friction-producing clench bead; and, FIGS. 4–10 are enlarged fragmentary perspective views of the tool wrist strap of the present invention illustrating different attachment arrangements employed in the strap between opposite ends of a strip to form a band of the strap and between adjacent ends of the looped cord and the band.

The clench bead 16 of the strap 10 is sized relative to and slidable along the looped cord 14 for producing sufficient friction therewith to hold the bead in any given position along the cord. Preferably, the bead 16 is about three-quarter inch long by about one-half inch outside diameter and one-eighth inch inside diameter. The bead 16 can be slidably moved by the person's hand P in opposing directions away from and toward the looped end portion 22 of the cord for respectively untightening and tightening the looped end portion in a noose-like configuration about the tool handle H. In one form illustrated in FIG. 2, the clench bead 16 has an outer plastic casing 28 composed of two identical halves glued together and defining a bore 30 therethrough which receives the looped cord 14. An internal annular recess 32 is defined in the bore 30. The bead 16 also includes a rubber O-ring 34 disposed in the recess 32. The O-ring 34 has an inside diametric size (approximately one-eighth inch) smaller than the cross-sectional size (approximately two times one-eighth inch) of the looped cord 14. The O-ring 34 will thereby frictionally crimp or squeeze the cord 14 as it passes therethrough. In another form illustrated in FIG. 3, the clench bead 16 is composed of a round body 36 made of injection molded rubber material or plastic material and having a bore 38 defined therethrough being sized (identical to the O-ring 34) to receive and frictionally squeeze the looped cord 14.

In FIGS. 4–10, different attachment arrangements are shown for connecting the ends 18 and 20 of the strip 17 together to form the band 12 and for anchoring the opposite ends 24 and 26 of the looped cord 14 to the band 12. In the first attachment arrangement shown in FIG. 4, the strip end 20 is doubled back on itself to form a pocket 40 which receives the adjacently-disposed opposite ends 24 and 26 of the looped cord 14. The doubled back strip end 20 is overlapped with the other strip end 18 and the strip ends 18 and 20 and looped cord ends 24 and 26 are all secured together such as by threaded stitches 42. Since the parts are intended to be permanently secured together, the elasticity and looseness of the band 12 would allow it to be pulled off the person's wrist W if the cord 14 should become entangled in moving machinery.

Figure 5:
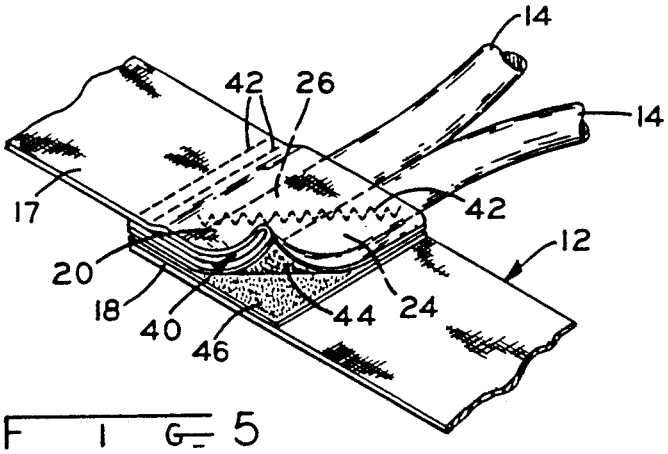

In the second attachment arrangement depicted in FIG. 5, again the strip end 20 is doubled back on itself to form a pocket 40 for the opposite ends 24 and 26 of the looped cord ends to be stitched together therein and thereby be attached to strip end 20. Next, patches 44 and 46 made of complementary fastening materials which make the patches attachable to and detachable from one another, are attached respectively to facing sides of the doubled back strip end 20 and the opposite strip end 18. The complementary fastening materials can be pile and hook material sold under the trademark VELCRO as shown in FIG. 5. In use, the VELCRO patches 44 and 46 each being approximately one inch by one inch in size, are pressed together to complete the band 12. Then, the ends 18 and 20 of the strip 17, and thus of the completed band 12, are detachable by applying sufficient pulling force, for instance in the range of two to four pounds, to the cord 14 to peel the VELCRO patches 44 and 46 apart. The cord 14 remains attached to the strip end 20. In this fashion, strap 10 and tool T are allowed to be pulled off a person's wrist W should they become entangled in moving machinery. The strip ends 18 and 20 are reattachable by applying sufficient compression force to press the patches 44 and 46 back together.

Figure 6:
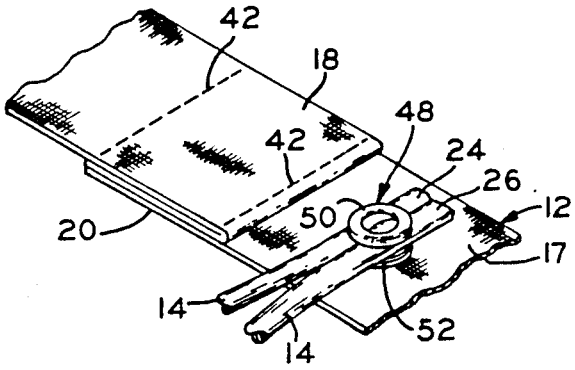
Figure 7:
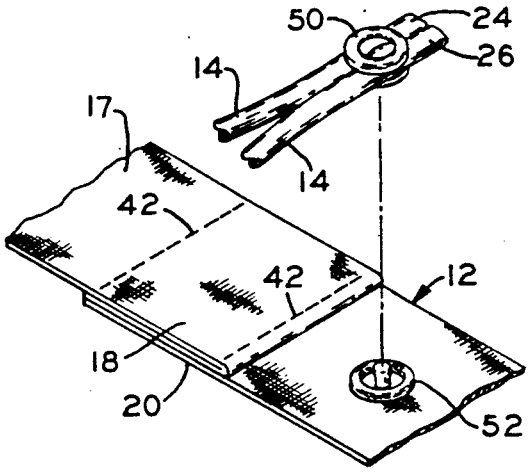
Figure 8:
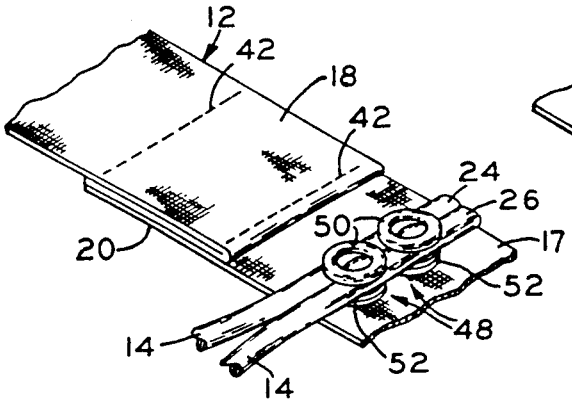

In a third attachment arrangement seen in FIGS. 6–8, the strip end 18 is doubled back on itself and then overlapped with and stitched to the opposite strip end 20 to complete the band 12. Then, a snap connector 48, composed of matable male and female parts 50 and 52 being attached respectively to the looped cord ends 24 and 26 and the band 12, is employed to detachably attach the cord 14 to the band 12. The one of the connector parts 50 or 52 on the band 12 can be attached at any location on the band, but preferably is located adjacent to the overlapped strip ends 18 and 20. Here, the looped cord 14 is detachable from the band 12 by applying sufficient pulling force, for instance two to four pounds, to the cord to unsnap the parts 50 and 52 of the snap connector 48. Of course, the male and female parts can be snapped back together to reattach the looped cord 14 to the band 12. One snap connector 48 provided on straps 10 is intended for use with light tools, whereas preferably a pair of snap connectors 48 are provided on straps 10 used with heavy tools. In the case of the latter, a pulling force of approximately four to six pounds would be required to unsnap the connectors 48.

Figure 9:
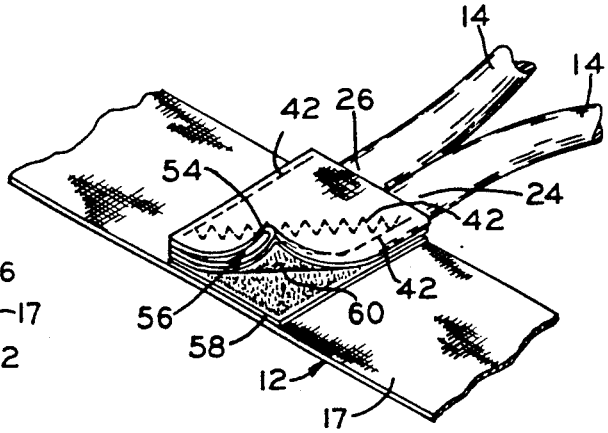

In a fourth attachment arrangement illustrated in FIG. 9, the strip ends 18 and 20 (not shown) are attached together as shown in FIG. 6 to complete the band 12. A separate piece of material 54, for instance the same as the material of the strap 17, two inches by one inch in size, is folded back on itself (to a one inch by one inch size) to form a pocket 56 which receives the looped cord ends 24 and 26. The folded separate material piece 54 and the looped cord ends 24 and 26 are stitched together. Then, at a separate location on the band 12 and on a face of the separate piece 54 are attached respective complementary VELCRO patches 58 and 60. As before with respect to the embodiment of FIG. 5, the patches 58 and 60 are pressed together to attach the looped cord 14 to the band 12 and can be peeled apart by application of sufficient pulling force to detach the cord 14 from the band 12.

Figure 10:
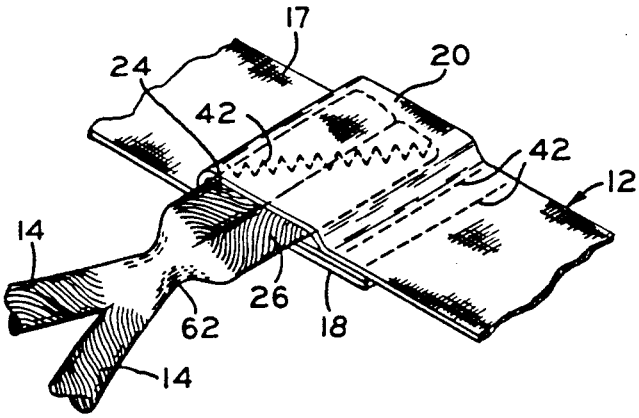

In a fifth attachment arrangement shown in FIG. 10, the adjacent strands of the looped cord 14 have been heated and melted together at a location 62 spaced a short distance from the adjacent opposite ends 24 and 26 thereof to cause a weakening of the cord 14 at this location. The attachment of the strip ends 18 and 20 and the looped cord ends 24 and 26 together is substantially the same as in FIG. 4. However, here the looped cord 14 can be severed from its stitched ends 24 and 26 and the band 12 by applying a sufficient pulling force, for instance five to six pounds, to the cord 14 to break it at its weakened location 62. With this attachment arrangement, once the cord 14 has been severed, the strap cannot be reused.

It is thought that the tool wrist strap of the present invention and many of its attendant advantages will be understood from the foregoing description and it will be apparent that various changes may be made in the form, construction and arrangement of the parts thereof without departing from the spirit and scope of the invention or sacrificing its material advantages, the forms hereinbefore described being merely exemplary embodiments thereof.

What is claimed is:

1. A tool wrist strap, comprising:

a band of flexible substantially elastic material adapted to fit about a person's wrist;

a looped cord of flexible substantially inelastic material having a looped free end portion and an opposite end portion attached to said band;

wherein a predetermined pulling force on said cord causes said flexible elastic band to elongate;

a clench member slidable on said looped cord and producing sufficient friction therewith to hold said member in any given position along said cord, said member being movable in opposing directions away from and toward said looped free end portion of said cord for respectively untightening and tightening said looped end portion in a noose-like configuration about a portion of a tool;

said band is formed by an elongated strip of said flexible substantially elastic material having opposite ends;

one of said strip ends is doubled back on itself to form a pocket;

said opposite cord end portion is received in said pocket and secured to said doubled back one strip end to thereby anchor said cord thereto; and, further comprising, a pair of patches, one of said patches on one side thereof having a pile fastening material and the other of said patches on one side thereof having a hook fastening material detachably attachable to said pile fastening material, one of said patches on an opposite side thereof being attached to said doubled back strip end and the other of said patches on an opposite side thereof being attached to the other of said strip ends, whereby said strip ends are attachable together to complete said and by pressing said patches at their respective one sides together and detachable from one another to open said band by applying sufficient pulling force to peel said one sides of said patches apart.

2. The strap as recited in claim 1, wherein said opposite cord end portion and said doubled back one strip end are secured together by being threadably stitched together.

3. A tool wrist strap, comprising:

a band of flexible substantially elastic material adapted to fit about a person's wrist;

a looped cord of flexible substantially inelastic material having a looped free end portion and an opposite end portion attached to said band;

wherein a predetermined pulling force on said cord causes said flexible elastic band to elongate;

a clench member slidable on said looped cord and producing sufficient friction therewith to hold said member in any given position along said cord, said member being movable in opposing directions away from and toward said looped free end portion of said cord for respectively untightening and tightening said looped end portion in a noose-like configuration about a portion of a tool;

said band is formed by an elongated strip of said flexible substantially elastic material having opposite ends;

one of said strip ends is doubled back on itself; and said doubled back strip end and the other of said strip ends are overlapped and secured together to thereby complete said band.

4. The strap as recited in claim 3, wherein said overlapped strip ends are secured together by being threadably stitched together.

5. A tool wrist strap, comprising:

a band of flexible substantially elastic material adapted to fit about a person's wrist;

a looped cord of flexible substantially inelastic material having a looped free end portion and an opposite end portion attached to said band;

wherein a predetermined pulling force on said cord causes said flexible elastic band to elongate;

a clench member slidable on said looped cord and producing sufficient friction therewith to hold said member in any given position along said cord, said member being movable in opposing directions away from and toward said looped free end portion of said cord for respectively untightening and tightening said looped end portion in a noose-like configuration about a portion of a tool;

a snap connector having releasable male and female parts, one of said parts attached to said band and the other of said parts attached to said opposite cord end portion, whereby said cord and said band are attachable together by applying sufficient compression force to said male and female parts of said connector to snap said parts together and said band and cord are detachable from one another by applying sufficient pulling force to said cord to unsnap said male and female parts of said connector from one another.

6. A tool wrist strap, comprising:

a band of flexible substantially elastic material adapted to fit about a person's wrist;

a looped cord of flexible substantially inelastic material having a looped free end portion and an opposite end portion attached to said band;

wherein a predetermined pulling force on said cord causes said flexible elastic band to elongate;

a clench member slidable on said looped cord and producing sufficient friction therewith to hold said member in any given position along said cord, said member being movable in opposing directions away from and toward said looped free end portion of said cord for respectively untightening and tightening said looped end portion in a noose-like configuration about a portion of a tool;

a separate piece of material, being substantially the same as said material of said strap, folded back on itself to form a pocket receiving said opposite cord end portion, said folded separate piece of material and said opposite cord end portion being secured together; and a pair of patches, one of said patches on one side thereof having a pile fastening material and the other of said patches on one side thereof having a hook fastening material being detachably attachable to said pile fastening material, one of said patches on an opposite side thereof being attached to said band and the other of said patches on an opposite side thereof being attached to said separate piece of material, whereby said cord and said band are attachable together to anchor said cord to said band by pressing said patches at their respective one sides together and detachable from one another to remove said cord from said band by applying sufficient pulling force to peel said one sides of said patches apart.

7. A tool wrist strap, comprising:

a band of flexible substantially elastic material adapted to fit about a person's wrist;

a looped cord of flexible substantially inelastic material having a looped free end portion and an opposite end portion attached to said band;

wherein a predetermined pulling force on said cord causes said flexible elastic band to elongate;

a clench member slidable on said looped cord and producing sufficient friction therewith to hold said member in any given position along said cord, said member being movable in opposing directions away from and toward said looped free end portion of said cord for respectively untightening and tightening said looped end portion in a noose-like configuration about a portion of a tool, said band is formed by an elongated strip of said flexible substantially elastic material having opposite ends;

one of said strip ends is doubled back on itself to form a pocket;

said opposite cord end portion is received in said pocket;

said doubled back strip end and the other of said strip ends are overlapped with one another;

said overlapped strip ends and said opposite cord end portion are secured together to thereby complete said band and anchor said cord thereto; and said looped cord substantially adjacent said opposite end portion thereof includes a region of structural weakness whereat said looped cord can be severed from its opposite end portion and thereby from said band by applying a sufficient pulling force to said looped cord to break said cord at said region of weakness.

8. The strap as recited in claim 7, wherein said overlapped strip ends and said opposite cord end portion are secured together by being threadably stitched together.

* * * * *